United States Patent [19]

Stout et al.

[11] Patent Number: 4,576,236

[45] Date of Patent: Mar. 18, 1986

[54] PERFORATION AND ISOLATION APPARATUS

[75] Inventors: Gregg W. Stout, Montgomery; John A. Nelson, Algernon Spring, both of Tex.; John H. Crisp, Aberdeen, Scotland

[73] Assignee: Baker Oil Tools, Inc., Orange, Calif.

[21] Appl. No.: 608,900

[22] Filed: May 10, 1984

[51] Int. Cl.[4] ..... E21B 33/12

[52] U.S. Cl. ..... 166/386; 166/55.1; 166/115; 166/125; 166/182; 166/192; 166/217; 166/237

[58] Field of Search ..... 166/386, 387, 115, 116, 166/150, 152, 180, 181, 182, 192, 194, 237, 238, 242, 125, 217, 206, 55.1

[56] References Cited

U.S. PATENT DOCUMENTS

| | | | |
|---|---|---|---|
| 3,011,549 | 12/1961 | Fredd et al. | 166/387 |
| 3,036,637 | 5/1962 | Dollison | 166/125 |
| 3,102,592 | 9/1963 | Dollison | 166/181 |
| 3,856,081 | 12/1974 | Canalizo | 166/217 |
| 4,437,522 | 3/1984 | Krause, Jr. et al. | 166/217 |

*Primary Examiner*—James A. Leppink
*Assistant Examiner*—Hoang C. Dang
*Attorney, Agent, or Firm*—Norvell & Associates

[57] ABSTRACT

A method and apparatus for effecting the sealing of a well conduit comprises the positioning of a sealing plug unit within a special nipple provided in the well conduit and defining first and second surfaces and a seal bore. The sealing plug unit is provided with external seal elements cooperable with the seal bore and a first and second latching elements respectively cooperable with the first and second surfaces provided on the nipple. The sealing plug is actuated by first passing it downwardly through the nipple and then retracting it upwardly, whereupon the first of the latching elements engages with one of the surfaces on the nipple, thus preventing further upward movement on the assembly and permitting the application of a tensile force to release the plugging unit from the remainder of the unit to bring a camming sleeve into engagement with the second latching element to cam such element outwardly into engagement with an upper recess of the nipple. The sealing plug unit may be removed from the nipple through the application of applied force which effects the release of the camming sleeve holding latch elements in their locked position, thus permitting the sealing plug unit to be forced through the special nipple and discarded into the bottom of the well.

22 Claims, 15 Drawing Figures

PERFORATION AND ISOLATION APPARATUS

BACKGROUND OF THE INVENTION

1. Field of the Invention:

The invention relates to a method and apparatus for effecting the plugging of a subterranean well conduit, and particularly to effecting the plugging subsequent to the perforation of the well casing or similar well conduit and coincident with the removal of the discharged perforating gun from the well.

2. History of the Prior Art:

The utilization of tubing mounted perforating guns has shown a marked increase in recent years. The tubing carried perforating gun offers flexibility in the methods of discharging the gun, permitting discharge by a dropped detonating bar, or by fluid pressure introduced through the tubing on which the gun is carried. More importantly, the mounting of the perforating gun on a tubing string, which, in some instances, could constitute the production conduit, permits an immediate flow of production fluid from the perforated zone through the simple expedient of providing a ported nipple in the tubing string immediately above the perforating gun. Alternatively, a ported sleeve valve which is opened by the fluid pressures generated in the well bore subsequent to discharge of the perforating gun may be employed as described in co-pending application, Ser. No. 551,764, filed Nov. 14, 1983 and assigned to the Assignee of this application. Such arrangement permits an immediate flow of production fluid from the perforated production formation and is very desirable in that it effects the removal of perforation debris from the formation and, if the particular formation does not require additional treatment, immediate production from the formation can be initiated.

The older method of perforating wells was to effect the perforation by a wireline carried gun and immediately introduce a kill fluid to keep the well under control while the perforating gun was removed and production conduit installed. The introduction of a kill fluid into the perforated production zone is always deleterious to the formation and many efforts have been made in the past to avoid such introduction. When, however, it is necessary to interrupt the flow of production fluid in the newly formed perforations for any reason, then the well operator generally had to resort to introduction of a kill fluid.

It would therefore be obviously desirable to permit the plugging a well subsequent to the perforation operation to permit the perforating gun to be removed and the introduction of well completion equipment without relying upon the use of a kill fluid to maintain the well under control.

SUMMARY OF THE INVENTION

This invention preferably provides a method and apparatus for perforating a well casing or similar conduit of a subterranean well in the vicinity of a production zone and then effecting the plugging of the well by removal of the tubing string upon which the perforating gun is carried. The perforating gun and its supporting tubing string are run through a larger tubing string, such as a production conduit which is sealably mounted within the bore of the well conduit which is to be perforated. A special nipple is incorporated in such production conduit above the perforated zone and this nipple defines a seal bore with which a sealing plug, shearably mounted on the bottom end of the perforating gun, cooperates in sealing relationship when the perforating gun is initially moved upwardly incident to its removal from the well after it is fired. The sealing plug effects a latching engagement with a pair of latching shoulders provided in the seal bore nipple and permits the perforating gun to be released from the sealing plug by the shearing of the shearable connection.

The sealing plug is additionally provided with a shearable mechanism operated by the imposition of a downward force on the plug to effect the release of the plug carried latches from the nipple and permit the plug to be dropped to the bottom of the well, thus reopening the well bore.

It sometimes happens that the perforating gun will not discharge. In this case, the sealing plug embodying this invention permits the withdrawal of the perforating gun and the plug mechanism without injury to either of these components, thus permitting the gun to be repaired and the entire assemblage re-inserted into the well to effect the perforating and plugging operation.

Further advantages of the invention will be readily apparent to those skilled in the art from the following detailed description, taken in conjunction with the annexed sheets of drawings, on which is shown a preferred embodiment of the invention.

DESCRIPTION OF THE PREFERRED EMBODIMENT

Figure 1A:
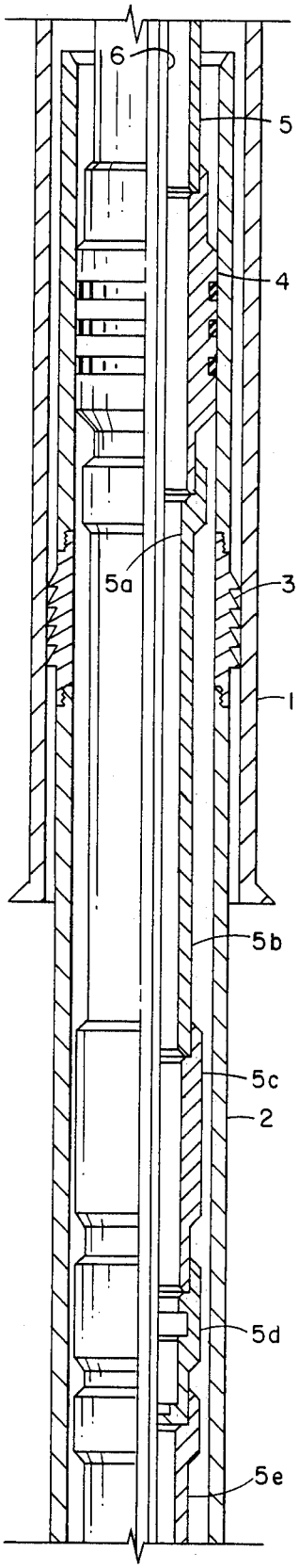
FIGS. 1A and 1B and 1C collectively represent a schematic vertical, quarter sectional view of a perforating and plugging apparatus embodying this invention, with the elements thereof disposed in their positions in the well bore just prior to the discharge of the perforating gun.
Figure 1B:
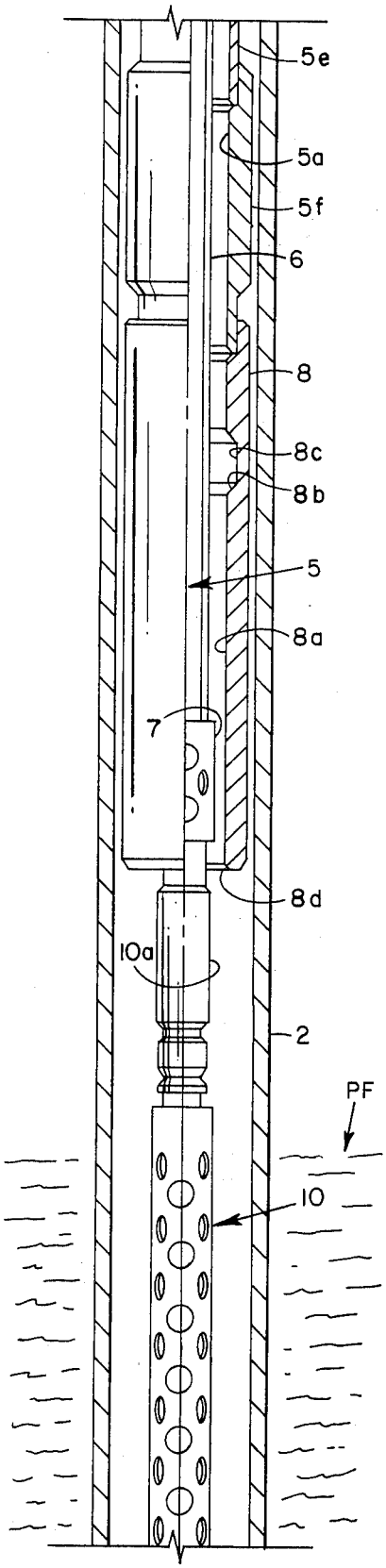
Figure 1C:
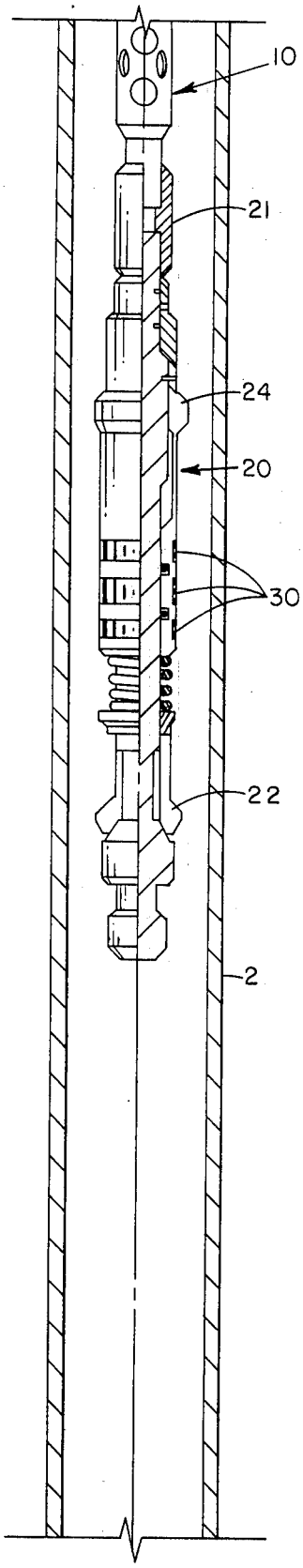

Referring to FIGS. 1A and 1B, there is schematically shown a perforating and plugging apparatus embodying this invention in inserted position within a subterranean well with the perforating gun 10 being disposed opposite that portion of the well conduit 2 which is to be perforated to communicate with a production formation PF. While well conduit 2 could comprise the well casing, in the specific example illustrated, it constitutes a liner 2 which is suspended from the bottom end of well casing 1 by a conventional hanger mechanism 3. Within the upper end of the liner 2, a conventional packer 4 is set and provides a sealable mounting for a production conduit 5 which extends to the well surface. Production conduit 5 is extended downwardly below the packer by conventional threaded sleeve elements 5*b*, 5*c*, 5*d*, 5*e* and 5*f*, terminating in a special latching nipple 8. All of such elements define a common conduit bore 5*a*.

A perforating gun 10 is inserted through the conduit bore 5*a* on a tubular work-string 6. While not always necessary, a perforated nipple 7 or a fluid pressure actuated port valve such as described in the above identified co-pending application, Ser. No. 551,764, filed Nov. 14, 1983, is incorporated in the tubular work string 6 at a position above the perforating gun 10 to receive initial production flow.

A well plugging unit 20 embodying this invention is secured in depending relationship to the bottom end of the perforating gun 10.

As previously mentioned, a special latching nipple 8 is conventionally secured to the bottom end of the production conduit 5. Nipple 8 defines a medially located internal seal bore portion 8*a* which is disposed below an upwardly facing latching surface 8*b* defined by an annular internal recess 8*c*. The bottom end of the latching nipple 8*d* defines a downwardly facing, sloped latching surface 8*d*. Both the perforating gun 10 and the sealing plug 20 are freely insertable through the bore 8*a* of the latching nipple 8. The sealing plug 20 is provided with a set of peripherally spaced, radially shiftable, lower latch elements 22 which are engagable with the downwardly facing surface 8*d* and a second set of peripherally spaced, radially shiftable, upper latching elements 24 which are engagable with the upwardly facing surface 8*b* of the latching nipple 8. However, as will be hereinafter described, these latches are mounted in such manner on the sealing plug 20 as to pass freely downwardly through the bore of the nipple 8. Additionally, the sealing plug 20 is provided with a plurality of external molded annular seal elements 30 for effecting a sealing engagement with the seal bore 8*a* of the special nipple 8.

Thus, the sealing plug unit 20 and the perforating gun 10 may be lowered to the position shown in FIG. 1A and 1B where the perforating gun 10 is disposed opposite a production formation PF. The perforating gun 10 is then discharged in this position by any conventional firing mechanism 10 mounted on the top of gun 10, such as by fluid pressure or the dropping of a detonating bar downwardly through the unobstructed bore 5*a* of the production conduit 5.

Figure 2A:
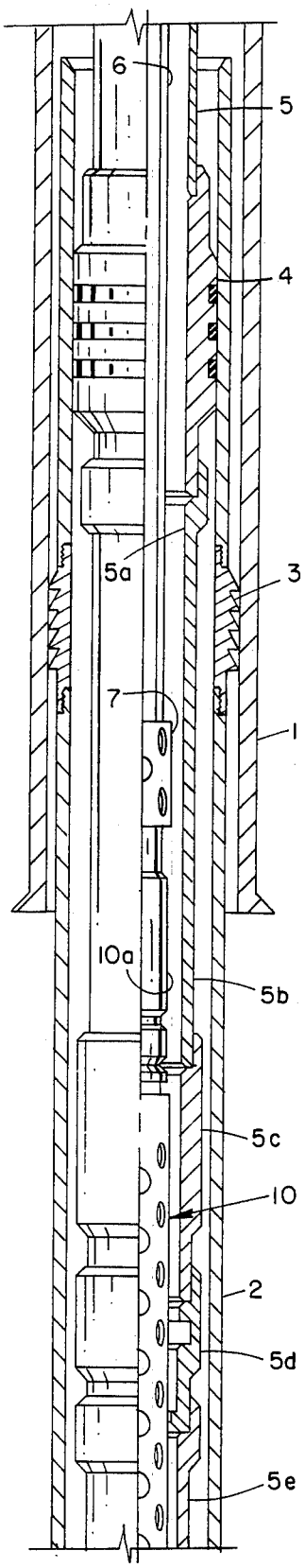
FIGS. 2A and 2B collectively represent a vertical sectional view, similar to FIGS. 1A, 1B, and 1C showing the elements of the apparatus in their positions occupied immediately subsequent to the perforating operating and during the initial withdrawal of the perforating apparatus from the well.
Figure 2B:
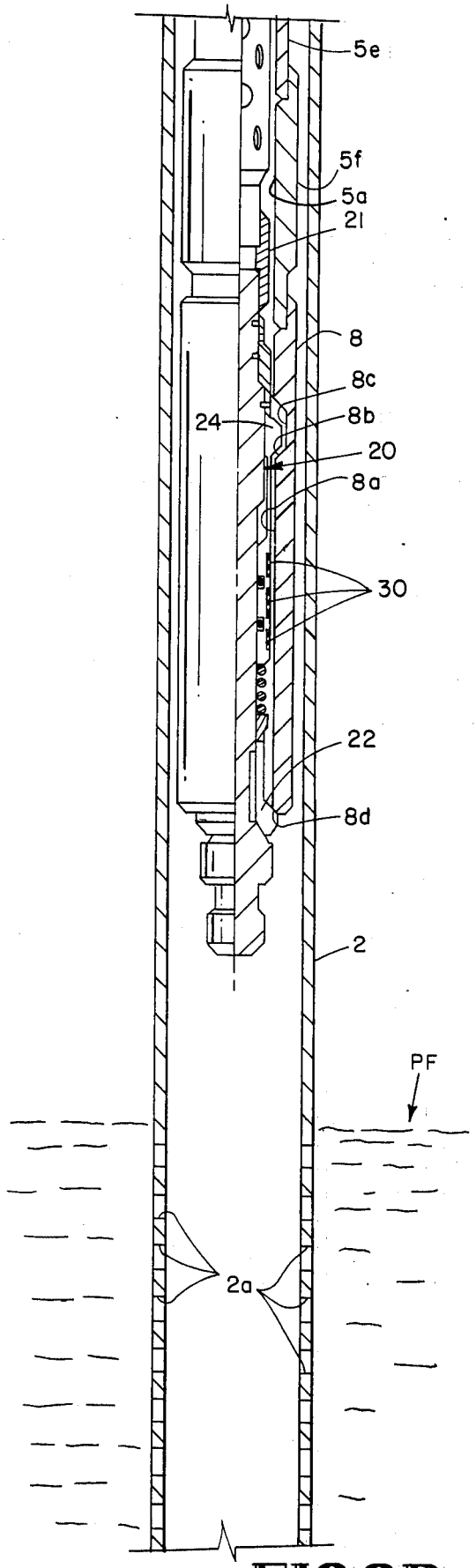

After discharge of the gun 10, resulting in the formation of the perforations 2*a* in the wall of liner 2, the work string 6 is raised so as to pull the discharged perforating gun 10 upwardly through the latching nipple 8 and to permit the sealing plug 20 to move upwardly within the nipple 8 to the position illustrated in FIG. 2B.

Figure 3A:
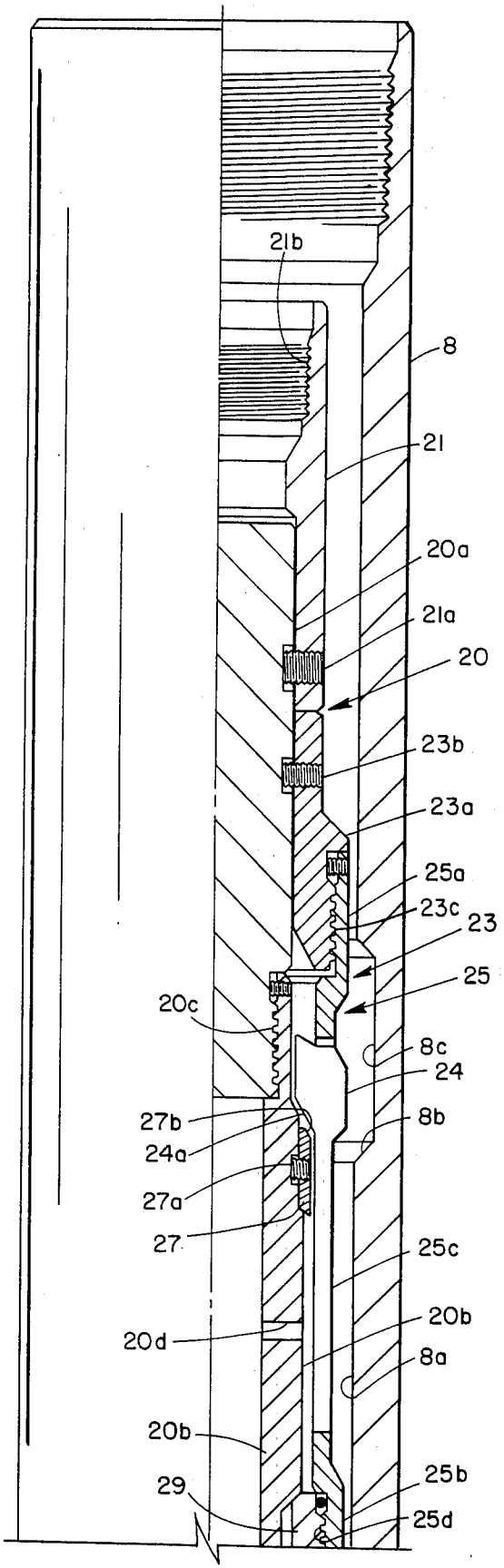
FIGS. 3A and 3B collectively comprise an enlarged scale, vertical sectional view of the sealing plug apparatus illustrated in FIG. 2B.
Figure 3B:
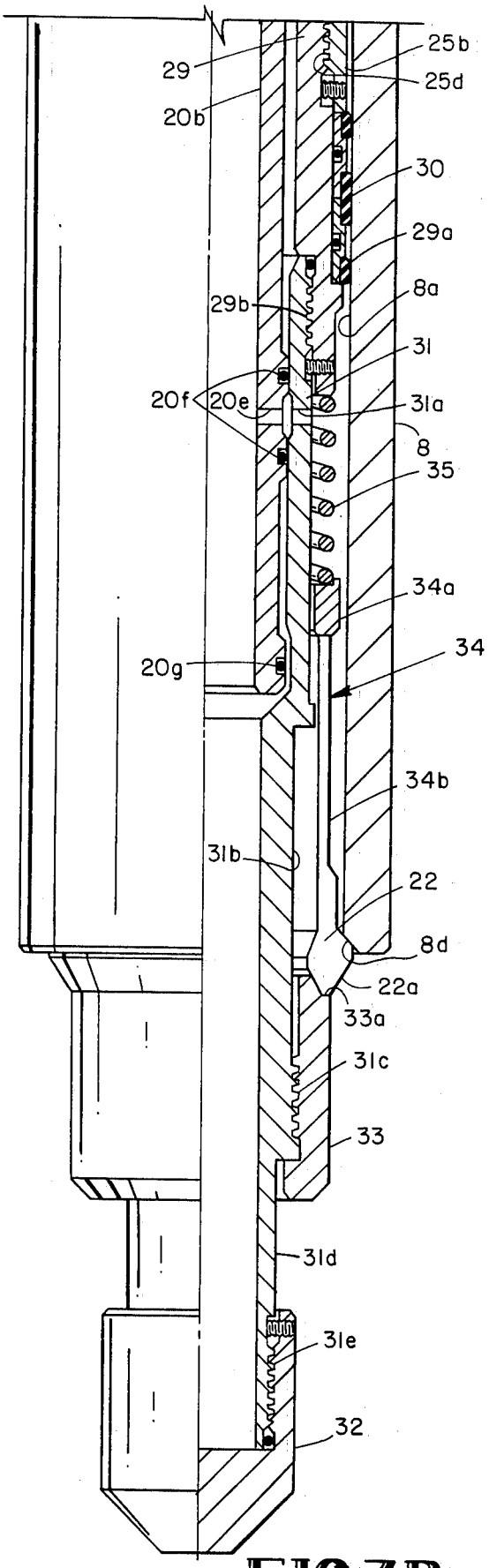

Referring now to FIGS. 3A and 3B, the construction of the sealing plug 20 is shown in enlarged detail. It will be noted that the sealing plug 20 comprises a solid central body portion 20*a* to which a connecting sub 21 is shearably connected by shear pin 21*a*. Connecting sub 21 is provided with internal threads 21*b* for effecting the securement of the connecting sub to the bottom end of the perforating gun 10. Central body portion 20*a* is extended downwardly by a sleeve extension 20*b* threadably secured to the bottom end of upper solid portion 20*a* by threads 20*c*. A radial port 20*d* is provided in the side wall of extension sleeve 20*b* near its upper end and a similar radial port 20*e* is provided in its side wall adjacent its lower end. Port 20*e* is straddled by a pair of O-ring seals 20*f*. A third O-ring seal 20*g* is provided at the bottom end of the extension sleeve 20*b* for a purpose to be hereinafter described.

Figure 4A:
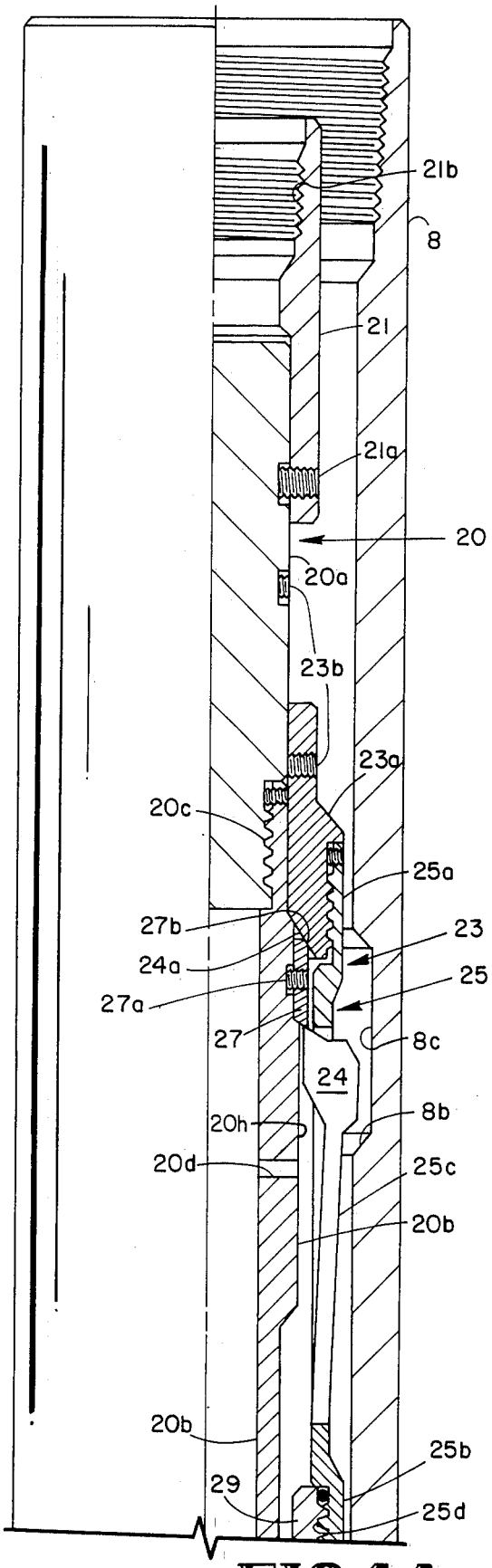
FIGS. 4A and 4B are views respectively similar to FIGS. 3A and 3B but showing the sealing plug in its fully locked position in the cooperating locking nipple.
Figure 4B:
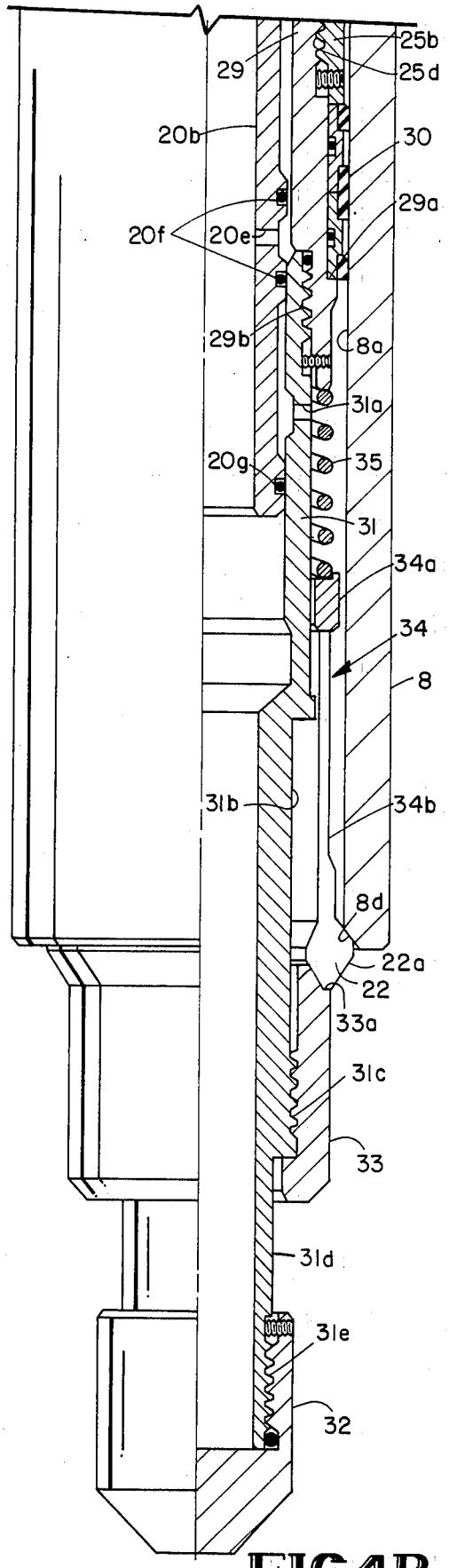
Figure 5A:
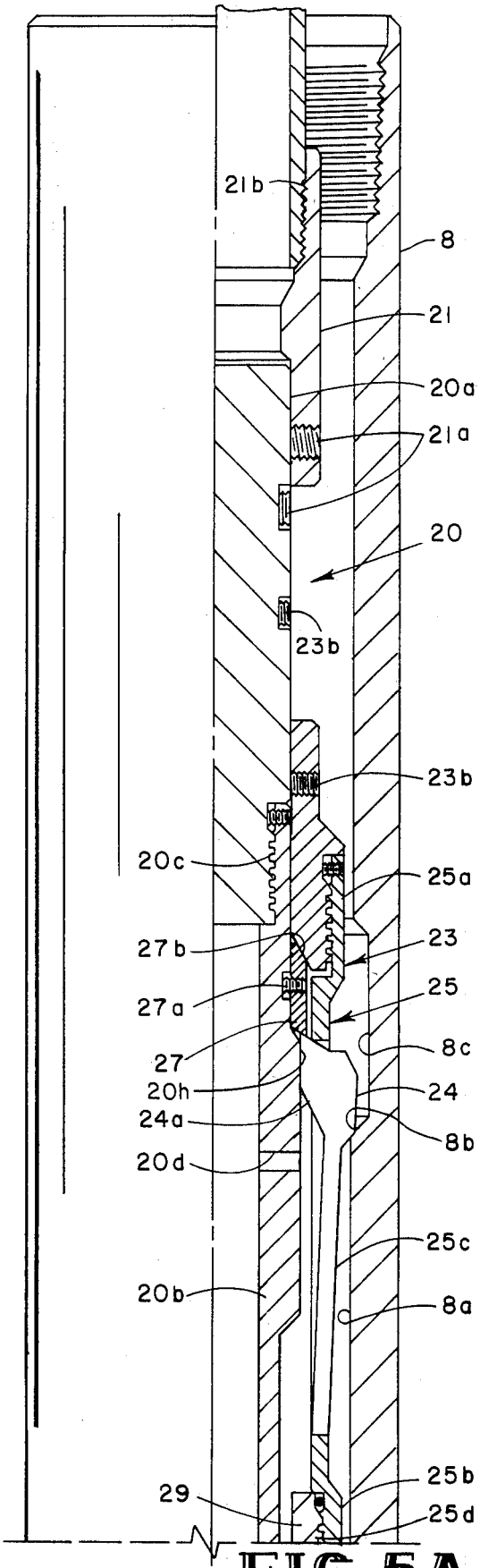
FIGS. 5A and 5B are views respectively similar to FIGS. 4A and 4B but showing the shearing release of the sealing plug from the bottom of the perforating gun.
Figure 5B:
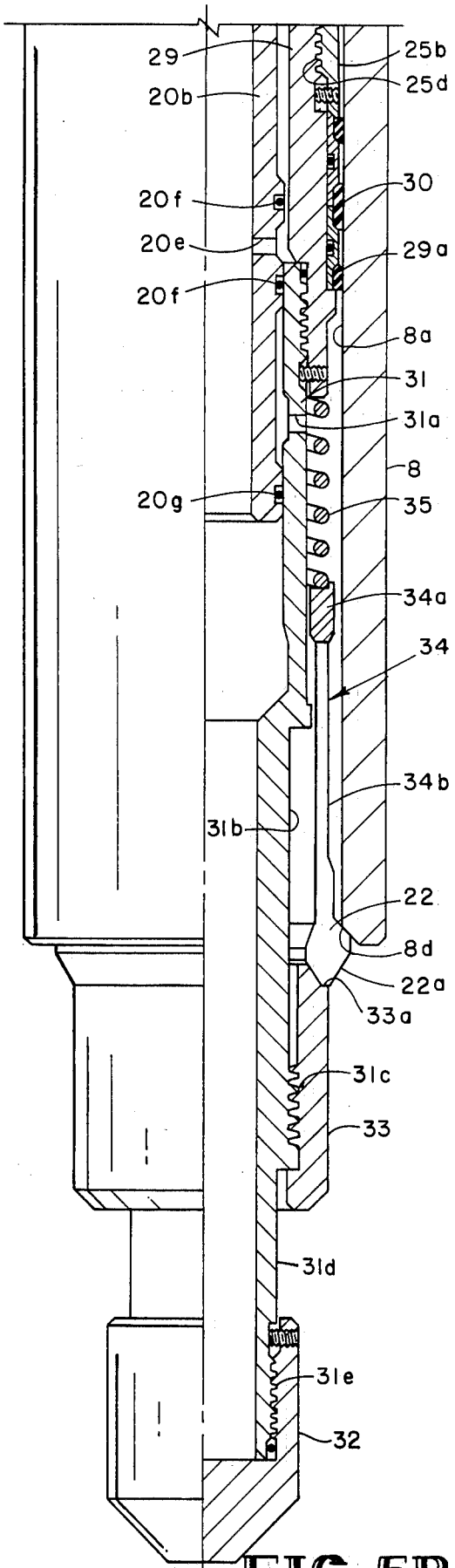
Figure 6A:
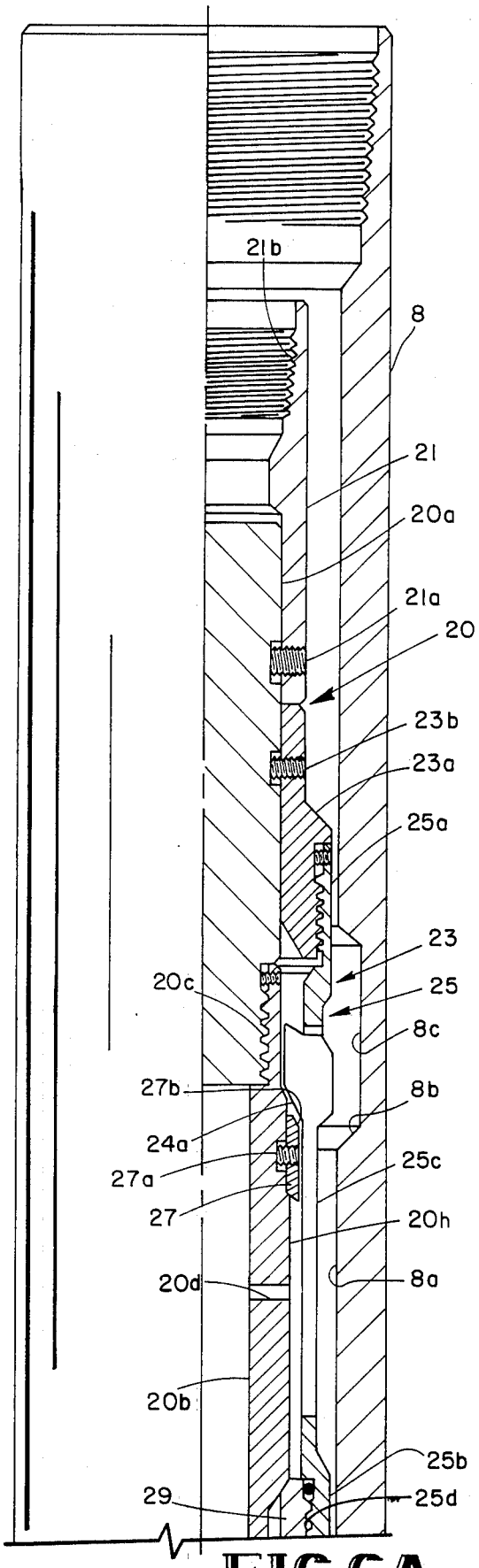
FIGS. 6A and 6B are views respectively similar to FIGS. 3A and 3B but illustrating the operation of the locking mechanism for the sealing plug to release same in the event the perforating gun does not discharge.
Figure 6B:
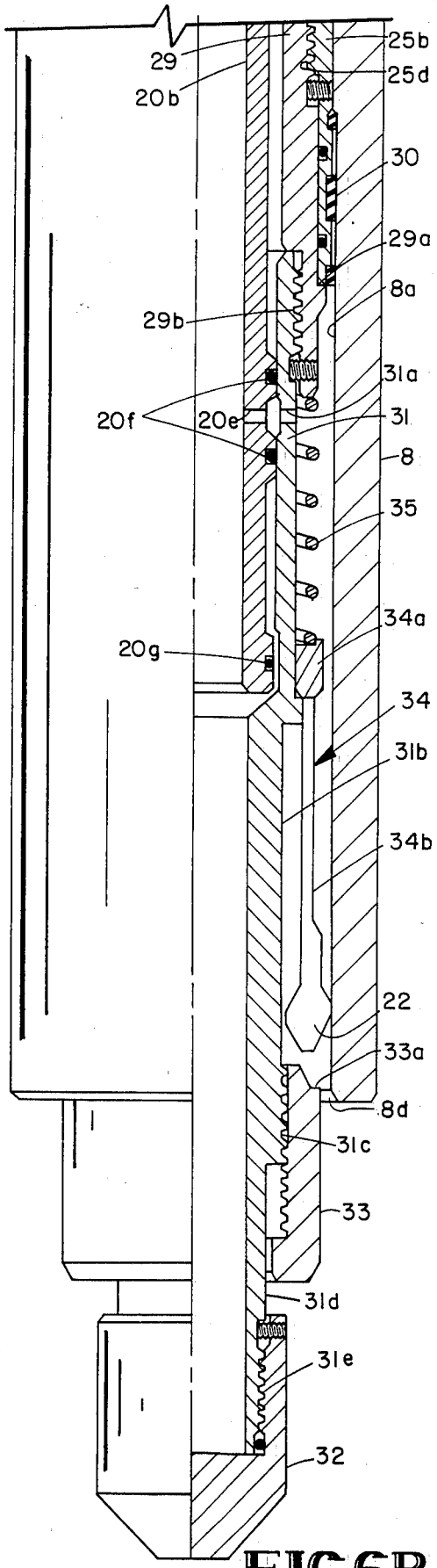
Figure 7A:
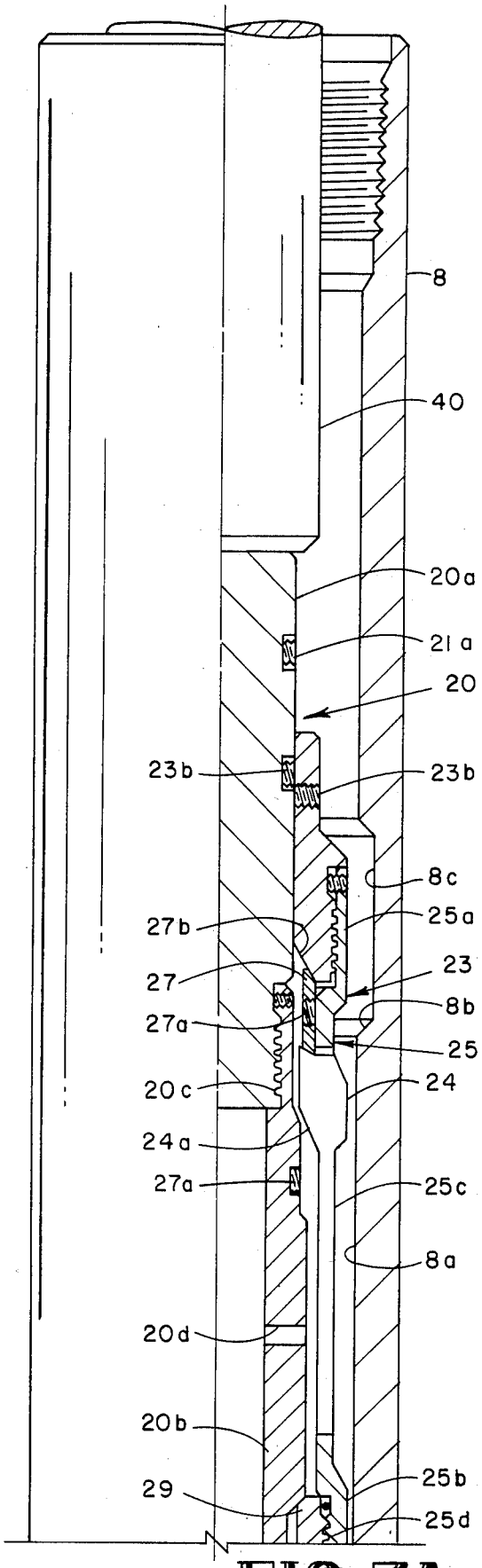
FIGS. 7A and 7B are views respectively similar to FIGS. 5A and 5B but illustrating the operation of the locking mechanism for the sealing plug to release such downwardly to the bottom of the well after the perforating gun has been withdrawn.
Figure 7B:
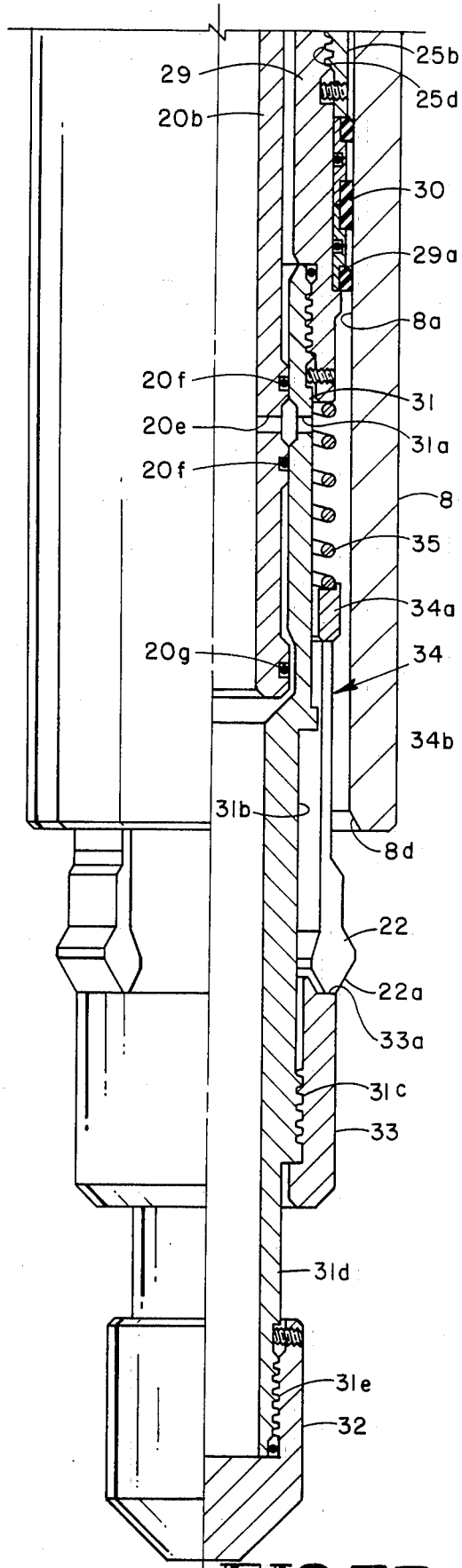

A sleeve assemblage 23 is provided which is secured to the periphery of the central body portion 20 in sealing relationship thereto provided in the run-in position by the pair of O-ring seals 20*f* and in a second axially displaced position by the lower O-ring 20*f* and the bottom O-ring 20*g* (FIG. 4B). The sleeve assemblage 23 comprises a connector sub 23*a* which is shear pinned to the upper portion of the central body portion 20 by a shear screw 23*b*. The bottom end of the connecting sub 23*a* is provided with external threads 23*c* for the securement thereto in depending relationship of an elongated collet 25 having both an upper ring portion 25*a* and a lower ring portion 25*b* and defining a plurality of peripherally spaced, radially shiftable arm portions 25*c*, each carrying an enlarged latching head 24 at its upper end. The upper and lower ring portions 25*a* and 25*b* are rigidly interconnected by segment-shaped bars (not shown) disposed intermediate the latching arms 25*c*. The normal position of the enlarged latching heads 24 is that illustrated in FIG. 3A wherein the latching head 24 is disposed in a radially inward position and hence will freely pass the upwardly facing latching surface 8*b* provided in the latching nipple 8.

A camming ring or sleeve 27 is mounted in surrounding relationship to the upper end of the sleeve extension 20*b* of the central body portion 20*a* and is shearably connected to such central body portion by a shear screw 27*a*. Camming ring 27 is provided with a sloped upper surface 27*b* which cooperates with similarly sloped surfaces 24*a* provided on the latching heads 24 so as to cam such latching heads 24 radially outwardly when the camming ring 27 is moved upwardly relative to the latching heads 24. Thus latching heads 24 are moved radially outwardly into engagement with the upwardly facing surface 8*b* of the latching nipple 8 by relative upward movement of the central body portion 20*a* with respect to the sleeve assemblage 23.

The lower collet ring portion 25*b* is provided with internal threads 25*d* in which is secured the upper end of a seal mounting sleeve 29. Seal mounting sleeve 29 defines an external upwardly facing shoulder 29*a* and a conventional molded seal assemblage 30 is mounted between shoulder 29*a* and the bottom end of the collet ring portion 25*b*.

Seal mounting sleeve 29 is further provided at its lower end with internal threads 29*b* which are threadably engaged by the top end of a spring guide sleeve 31. Spring guide sleeve 31 extends downwardly past the bottom end of the central body extension sleeve 20*b* and is traversed by a radial port 31*a* which, in the position of the elements illustrated in FIG. 3B, is arranged in juxtaposition to the port 20*e* of the central body portion 20. In this position, the seals 20*f* straddle the aligned ports and insure a fluid flow path between the interior bore of the extension sleeve 20*b* and the annulus surrounding the sealing plug assemblage 20.

The lower end 31*b* of the spring guide sleeve 31 is of reduced diameter but of increased radial thickness. The lower end of guide sleeve portion 31*b* is provided with external left hand threads 31*c* for the mounting thereon of a latch retaining sleeve 33 which cooperates with the lower radially shiftable latching heads 22. Below the left hand threads 31*c*, the extension portion 31*d* is of further reduced diameter as indicated at 31*d* and is externally threaded at 31*e* to receive a sealing cap 32.

A second collet 34 is provided having a ring portion 34*a* slidably surrounding the upper end of the spring guide sleeve 31. Collet 34 is provided with a plurality of peripherally spaced, downwardly extending resilient arms 34*b*, each of which terminates in one of the lower locking heads 22. Collet 34 is normally biased downwardly by a spring 35 which operates between the top end of the collet ring 34*a* and the bottom end of the seal mounting sleeve 29. The downward movement of the collet 34 is limited by the engagement of the lower locking heads 22 with the upwardly facing end surface 33*a* of the latch retaining sleeve 33. Because each of the latching heads 22 are provided with a downwardly facing, sloped surface 22*a*, it is apparent that the latching heads 22 will ride readily over any obstruction encountered in the bore of the production conduit or in the latching nipple 8 as the sealing plug unit 20 is run through such bores, by moving upwardly to clear sleeve 33, and then inwardly since there is adequate radial room for the collet heads 22 to be sprung inwardly in the space provided by the reduced diameter portion 31*b* of the spring guide sleeve 31.

When the sealing plug unit 20 is inserted within the latching nipple 8, the external seal elements 30 will effect a sealing engagement with the seal bore 8*a*. Since the well is commonly full of fluid, this would prevent any upward flow of fluid past the sealing plug unit as it is moved downwardly through the latching nipple 8. The ports 31*a*, 20*e* and 20*d* provide a bypass to permit ready flow of fluid around the external seals 30 during the downward movement of the sealing plug unit 20 through the latching nipple 8.

OPERATION

The operation of the aforedescribed apparatus may be readily understood by reference to FIGS. 3A, 3B–7A, 7B. It was previously mentioned that FIGS. 3A–3B represent the position of sealing plug unit 20 after the perforation operation has been completed and the work string and perforating gun 20 moved upwardly until the lower latching heads 22 engage the downwardly facing latching surface 8*d* provided on the bottom end of the latching nipple 8. The latch retaining sleeve 33 also engages the latching heads 22 and prevents inward movement of such latching heads thus, effectively locking the sealing plug unit 20 against upward movement relative to the latching nipple 8.

The shearing strength of the shear pin 23*b* is selected to be approximately one half that of the shear pin 21*a*. Accordingly, upon the application of a moderate upward force to the work string 6, the shearing of shear pin 23*b* can be effected, without affecting shear pin 21*a*. Upon the shearing of the shear pin 23*b*, and further upward movement of work string 6, the components of the device assume the positions shown in FIGS. 4A–4B.

As illustrated in these drawings, the shear pin 23*b* has been sheared, thus permitting upward movement of the central body portion 20*a* with respect to the surrounding sleeve assemblage 23. This movement brings the camming ring 27 upwardly past the upper locking heads 24, forcing such locking heads 24 outwardly into the recess 8*c* of the latching nipple 8 and retaining the locking heads in such recess, hence in locking engagement with the upwardly facing locking surface 8*b*, by the adjoining wall surface 20*h* constituting the exterior of the body sleeve extension 20*b*. Additionally, the lower outer corner of the camming ring 27 now rests upon the top inner surface of the latching heads 24 to prevent any return movement of the central body portion 20*a* relative to the external sleeve assembly 23. It is therefore apparent that in this position, the sealing plug 20 is securely locked in the latching nipple 8 against both upward or downwardly applied mechanical or fluid pressure forces and an effective plugging of the bore 5*a* of the production conduit 5 has been achieved.

The aforedescribed upward movement of central body portion 20*a* also moves the lower O-ring 20*f* and the bottom O-ring 20*g* into straddling relationship with radial port 31*a*, thus cutting off the bypass passage.

The next step of the operation involves the application of sufficient upward force to the tubular work string 6 to effect the shearing of the shear pin 21*a* which secures the sealing plug unit 20 to the perforating gun 10. Accordingly, the gun can be readily removed from the well (FIG. 5A–5B) and the well remains effectively blocked against any production flow.

It sometimes happens that the firing mechanism 10*a* of perforating gun 10 malfunctions and does not discharge. In such case, it is highly desirable that the gun with the sealing plug unit 20 attached thereto be removable from the well without damage. This may be readily accomplished with the aforedescribed apparatus. The application of a modest upward force to the work string 6, which is not sufficient to effect the shearing of shear pin 23*b*, will nonetheless effect a locking of the retaining sleeve 33 against rotational movement due to its engagement with the lower latching heads 22. A right hand rotational movement of the work string will then effect an unthreading of the retaining sleeve 33 to the position illustrated in FIG. 6B wherein the retaining sleeve 33 is backed downwardly on the left hand threads 31*c* sufficient to release the lower locking heads 22 for radially inward movement, thus permitting the entire plug unit to be removed upwardly through the seal bore 8*a* without interference. Thus, both the perforating gun 10 and the undamaged seal plug unit 20 may be removed from the well. After repair of the firing mechanism of the perforating gun 10, the sealing plug unit 20 may be restored to its original operative position by retightening the retaining sleeve 33 on the left hand threads 31*c* to the position illustrated in FIG. 3B, and the entire mechanism is ready for re-insertion into the well.

When the time comes to remove the sealing plug unit 20 from the well and permit production flow upwardly through the production conduit 5, (see FIGS. 7A and 7B) this may be readily accomplished by lowering a pushing bar 40 into the well either by wireline or at the end of a tubing string, and providing sufficient force from the pushing bar 40 on the top end of the central body portion 20*a* of sealing plug 20 to effect the shearing of the shear pin 27*a* which secures the camming ring 27 to the body portion 20*a* and then cause ring 27 to move upwardly relative to the body portion 20*a*. Thus the upper body portion 20*a*, which is of smaller diameter than the body portion extension sleeve 20*b*, moves downwardly relative to the upper locking heads 24 and provides space for such locking heads to retract radially inwardly to clear the upwardly facing locking surface 8*b* provided in the latching nipple 8. Thus, the entire sealing plug unit 20 may then be pushed downwardly through the latching nipple 8 and discarded into the bottom of the well.

From the foregoing description, it will be readily apparent to those skilled in the art that the aforedescribed sealing plug unit may be advantageously used in conjunction with a perforating gun, but may also be used to plug any conduit incorporating a special nipple configured like the latching nipple 8. Moreover, the sealing plug unit 20 may be readily and reliably secured and locked in sealed relationship with respect to the latching nipple 8 and removed from such relationship through the simple application of a downward force to the central body portion 20*a* of the sealing plug unit 20.

Although the invention has been described in terms of specified embodiments which are set forth in detail, it should be understood that this is by illustration only and that the invention is not necessarily limited thereto, since alternative embodiments and operating techniques will become apparent to those skilled in the art in view of the disclosure. Accordingly, modifications are contemplated which can be made without departing from the spirit of the described invention.

What is claimed is and desired to be secured by Letters Patent is:

1. Apparatus for plugging a subterranean well conduit above a perforated zone, comprising: insertable means in the well conduit above the perforated zone; said insertable means defining a seal bore and a first upwardly facing shoulder above said seal bore and a second downwardly facing shoulder below said seal bore; a plug assembly comprising a central body portion carried by a work string; a downwardly extending sleeve assembly slidably and sealably mounted on said central body portion and secured to said central body portion by a first releasing means; sealing means mounted on the exterior of said sleeve assembly and cooperating with said seal bore in slidable, sealable relationship; means closing the bore of said sleeve assembly; a first radially shiftable latching means mounted on said sleeve assembly below said sealing means, said first latching means being freely passable in one direction through said seal bore and said second shoulder in said nipple but lockingly engagable with said second shoulder upon movement of said sleeve assembly in said nipple in another direction whereby an applied upward force to said central body portion releases said first releasing means; means including a second releasable means for connecting the upper portions of said central body portion to a work string; a second radially shiftable latching means mounted on said sleeve assembly and normally positioned in a retracted, inoperative position relative to said first shoulder; means for camming said second radially shiftable latching means outwardly to an engaged position with said first shoulder by upward movement of said central body portion relative to said sleeve assembly subsequent to release activation of said first releasing means, whereby said plug assembly is securely and sealably latched in said nipple and may be left in position by releasing said second releasing means.

2. The plugging apparatus of claim 1 wherein said first latching means comprises a collet having a ring portion mounted on said sleeve assembly and peripherally spaced resilient arm portions carrying latching heads biased radially outwardly.

3. The apparatus of claim 1 wherein said second latching means comprises a collet having a ring portion forming part of said sleeve assembly and peripherally spaced, radially shiftable arm portions carrying latching heads cammable outwardly to engage said downwardly facing internal shoulder.

4. The plugging apparatus of claim 1 wherein said first latching means comprises a collet having a ring portion mounted on said sleeve assembly and peripherally spaced, resilient arm portions carrying latching heads biased radially outwardly; and said second latching means comprises a second collet having a ring portion forming part of said sleeve assembly and peripherally spaced, radially shiftable arm portions carrying latching heads cammable outwardly to engage said second shoulder.

5. Apparatus defined in claim 1 wherein said sleeve assembly has a radial port bypass passage permitting fluid flow around said external seals during initial insertion of said plug assembly in said seal bore, and axially spaced sealing means on one of said central body portion and said sleeve assembly for straddling and sealing said radial port by upward movement of said central body portion relative to said sleeve assembly.

6. The apparatus of claim 5 wherein said bypass port passage includes a pair of radial ports in said central body portion respectively located above and below said external seals and communicating with an axial passage in said central body portion; and a third radial port in said sleeve assembly alignable with one of said pair of radial ports during insertion of said plug assembly into said nipple to permit bypass fluid flow around said external seals.

7. The apparatus of claim 1 further comprising a cam sleeve connected to said central body portion by a third releasing means; said cam sleeve being constructed and arranged to shift said second radially shiftable latching means to said engaged position wherein said cam sleeve axially overlies said second radially shiftable latching means to prevent movement in one direction of said plug assembly relative to said nipple; said third releasing means being releasable by application of a force to said central body portion to release said second radially shiftable latching means and drop said plug assembly through said nipple.

8. The apparatus of claim 1 wherein a retaining sleeve for said first radially shiftable latching means is secured to said sleeve assembly by left hand threads; the top portions of said retaining sleeve cooperating with said first radially shiftable latching means to lock same in engagement with said second shoulder, whereby prior to activation of said first releasing means to lock the first radially shiftable locking means, the plug assembly can be released for movement through said nipple by right hand rotation of the work string.

9. Apparatus for plugging a well conduit above a newly perforated zone incident to withdrawal of the perforating gun from the conduit comprising, in combination: a nipple insertable in the well conduit above the perforated zone; said nipple defining a seal bore and an upwardly facing internal shoulder above said seal bore and a downwardly facing internal shoulder below said seal bore; a work string supported perforating gun freely insertable through said nipple; a plug assembly secured in depending relationship to said perforating gun; said plug assembly comprising a central body portion; a sleeve assembly secured to said central body portion by a first shearable means; sealing means mounted on the exterior of said sleeve assembly and cooperating with said seal bore in slidable, sealable relationship; means closing the bore of said sleeve assembly; a first radially shiftable latching means mounted on said sleeve assembly below said sealing means, said first latching means being freely downwardly passable through said seal bore and said downwardly facing internal shoulder in said nipple but lockingly engagable with said downwardly facing internal shoulder upon return upward movement of said sleeve assembly into said nipple, whereby an upward force applied to said central body portion shears said first shearable means; means including a second shearable means for connecting the upper portions of said central body portion to said perforating gun; a second radially shiftable latching means mounted on said sleeve assembly and normally positioned in an inwardly retracted, inoperative position relative to said upwardly facing internal shoulder but shiftable to an engaged position with said upwardly facing internal shoulder by upward movement of said central body portion relative to said sleeve assembly subsequent to shearing of said first shearable means, whereby said plug assembly is securely and sealably latched in said nipple and may be left in position by shearing said second shearable means to withdraw said perforating gun from the well conduit.

10. The plugging apparatus of claim 9 wherein said first latching means comprises a collet having a ring portion mounted on said sleeve assembly and peripherally spaced resilient arm portions carrying latching heads biased radially outwardly.

11. The apparatus of claim 9 wherein said second latching means comprises a collet having a ring portion forming part of said sleeve assembly and peripherally spaced, radially shiftable arm portions carrying latching heads cammable outwardly to engage said downwardly facing internal shoulder.

12. The plugging apparatus of claim 9 wherein said first latching means comprises a collet having a sleeve portion mounted on said sleeve assembly and peripherally spaced, resilient arm portions carrying latching heads biased radially outwardly; and said second latching means comprises a second collet having a ring portion forming part of said sleeve assembly and peripherally spaced, radially shiftable arm portions carrying head portions cammable outwardly to engage said downwardly facing internal shoulder.

13. Apparatus defined in claim 9 wherein said sleeve assembly has a radial port bypass passage permitting fluid flow around said external seals during initial insertion in said seal bore, and axially spaced sealing means on one of said central body portion and said sleeve assemblage for straddling and sealing said radial port by said upward movement of said central body portion relative to said sleeve assemblage.

14. The method of plugging a conduit of a subterranean well comprising the steps of:

(1) incorporating a nipple in the conduit having a bore, an upwardly facing latching surface above the seal bore and a downwardly facing surface below the seal bore;

(2) moving a plug unit downwardly into said nipple, said plug unit having a central body portion shearably connected to a sleeve assembly having first latch means engagable with said downwardly facing surface, second latch means being outwardly cammable to engage said upwardly facing surface, and external seal elements engagable with said seal bore;

(3) raising the plug unit to engage said first latch means with said downwardly facing latching surface;

(4) applying upward force to said central body unit to shear the connection to said sleeve assembly and move a camming surface on said central body portion against said second latch means to engage said upwardly facing surface, thereby sealably locking said plug unit in said nipple; and (5) shearably connecting said camming surface to said central body portion, and applying a downward force to said central body portion to shear the shearable connection of said camming surface to permit discharge of said plug unit downwardly through said nipple.

15. The method of plugging a well conduit subsequent to perforating a production zone comprising the steps of:

(1) incorporating a nipple in the conduit having a seal bore, a first latching surface above the seal bore and a second latching surface below the seal bore;

(2) releasably attaching a plug unit to the bottom of a perforating gun and passing the gun and plug unit downwardly through the nipple, said plug unit having a central body portion releasably connected an assembly having first means engagable with said second latching surface, second means outwardly cammable to engage said first latching surface and external seal elements engagable with said seal bore;

(3) discharging the perforating gun;

(4) raising the discharged perforating gun through the nipple until said plug unit enters the nipple and engages said first means with said second latching surface;

(5) applying upward force to said central body unit to release the connection to said assembly and move a camming surface on said central body portion against said second means to engage said first surface, thereby sealably locking said plug unit in said nipple; and (6) raising the perforating gun to release the connection to the plug unit and remove the perforating gun from the well conduit.

16. The method of claim 15 further comprising the step of by-passing fluid around said external seal elements during downward insertion of said plug unit in said nipple, and closing said fluid bypass during upward movement of said central body portion relative to said assembly.

17. The method of claim 15 further comprising the steps of releasably connecting said camming surface to said central body portion, and applying a downward force to said central body portion to release the releasable connection of said camming surface to permit discharge of said plug unit downwardly through said nipple.

18. Apparatus for plugging a well conduit above a perforated zone incident to withdrawal of the perforating gun from the conduit comprising, in combination; a nipple insertable in the well conduit above the perforated zone; said nipple defining a seal bore and an upwardly facing internal shoulder above said seal bore and a downwardy facing internal shoulder below said seal bore; a work string supported perforating gun freely insertable through said nipple; a plug assembly secured in depending relationship to said perforating gun; said plug assembly having first latch means engagable with the downwardly facing nipple latching surface by upward movement relative to the nipple; second latch means on said plug assembly cammable into engagement with the upwardly facing nipple latching surface by upward force applied to said plug assembly after said first latch means are engaged, thereby locking said plug assembly in said nipple; and external seal means on said plug assembly engagable with said seal bore in the locked position of said plug assembly in the nipple.

19. The apparatus of claim 18 wherein said first latching means comprises a collet having a ring portion mounted on said sleeve assembly and peripherally spaced resilient arm portions carrying latching heads biased radially outwardly.

20. The apparatus of claim 18 wherein said second latching means comprises a collet having a ring portion forming part of said sleeve assembly and peripherally spaced, radially shiftable arm portions carrying latching heads cammable outwardly to engage said downwardly facing internal shoulder.

21. The plugging apparatus of claim 18 wherein said first latching means comprises a collet having a ring portion mounted on said sleeve assembly and peripherally spaced, resilient arm portions carrying latching heads biased radially outwardly; and said second latching means comprises a second collet having a ring portion forming part of said sleeve assembly and peripherally spaced, radially shiftable arm portions carrying latching heads cammable outwardly to engage said downwardly facing internal shoulder on said nipple.

22. The apparatus of claim 18 wherein said sleeve assembly has a radial port bypass passage permitting fluid flow around said external seals during initial insertion of said plug assembly in said seal bore, and axially spaced sealing means on one of said central body portion and said sleeve assembly for straddling and sealing said radial port by upward movement of said central body portion relative to said sleeve assembly.

* * * * *